US009963327B2

(12) United States Patent
Neves

(10) Patent No.: US 9,963,327 B2
(45) Date of Patent: May 8, 2018

(54) FRUSTOCONICAL DRUM WINCH FOR LIFTING LOADS WITH HOOK REDUCED APPROXIMATION LIFTING HEIGHT

(71) Applicant: Flexcrane, Inc., Burleson (TW)

(72) Inventor: Vitor Hugo Carneiro dos Santos Neves, Maia (PT)

(73) Assignee: Flexcrane, Inc., Burleson, TX (US)

( * ) Notice: Subject to any disclaimer, the term of this patent is extended or adjusted under 35 U.S.C. 154(b) by 0 days. days.

(21) Appl. No.: 14/715,460

(22) Filed: May 18, 2015

(65) Prior Publication Data

US 2016/0340160 A1 Nov. 24, 2016

(51) Int. Cl.

| | |
|---|---|
| ***B66D 1/30*** | (2006.01) |
| ***B66D 3/00*** | (2006.01) |
| ***B66D 1/00*** | (2006.01) |
| ***B66D 3/18*** | (2006.01) |

(52) U.S. Cl.

CPC ..... *B66D 1/30* (2013.01); *B66D 1/00* (2013.01); *B66D 3/006* (2013.01); *B66D 3/18* (2013.01)

(58) Field of Classification Search

CPC . B66D 1/30; B66D 1/00; B66D 1/365; B66D 3/006; B66D 3/18

See application file for complete search history.

(56) References Cited

U.S. PATENT DOCUMENTS

| | | | | |
|---|---|---|---|---|
| 3,690,409 | A * | 9/1972 | Brauss | B66D 1/14 182/142 |
| 4,552,340 | A * | 11/1985 | Sheppard | B66D 3/18 254/346 |
| 4,575,050 | A * | 3/1986 | Bechmann | B66D 1/7405 254/286 |
| 5,002,259 | A * | 3/1991 | Manning | B66D 1/18 192/93 A |
| 5,280,880 | A * | 1/1994 | Ewing | B65B 11/08 187/259 |
| 5,829,737 | A * | 11/1998 | Gersemsky | B66D 1/38 254/278 |
| 6,523,806 | B2 * | 2/2003 | Bartal | B66D 1/365 254/272 |
| 7,819,388 | B2 * | 10/2010 | McCallion | E02D 5/808 24/136 B |
| 8,317,159 | B2 * | 11/2012 | Hoffend, III | A63J 1/028 160/143 |
| 2005/0056819 | A1 * | 3/2005 | Pockl | B66D 1/365 254/277 |
| 2009/0134373 | A1 * | 5/2009 | Arzberger | B66D 1/365 254/361 |
| 2015/0008381 | A1 * | 1/2015 | Hausladen | B66D 1/30 254/288 |

FOREIGN PATENT DOCUMENTS

| | | | |
|---|---|---|---|
| EP | 0056909 | A2 | 8/1982 |
| FR | 2662430 | A1 | 11/1991 |
| GB | 1441994 | A | 7/1976 |
| PT | 106802 | B | 8/2014 |

* cited by examiner

*Primary Examiner* — Michael E Gallion
(74) *Attorney, Agent, or Firm* — patenttm.us

(57) ABSTRACT

A load lifting winch suspending a load from a hook (3) and a cable (5) which is wound onto a frustoconical drum (1) in order to reduce the winch vertical dimension when the hook (3) is in the fully upright position allowed by available vertical space elevation, and simultaneously decrease the forces applied to the lifting drive motor (4) as the load rises.

3 Claims, 2 Drawing Sheets

FRUSTOCONICAL DRUM WINCH FOR LIFTING LOADS WITH HOOK REDUCED APPROXIMATION LIFTING HEIGHT

This disclosure relates to the winch for lifting loads used in lifting equipment, specially on overhead or gantry cranes, for vertical lift of loads hanging on hooks and steel wire cables wrapped on a cable drum.

BACKGROUND

The lifting of a certain body mass, commonly called load, is typically carried out by mechanized equipment vertically suspending it, by means of hooks associated with flexible linear elements such as cables or chains, subsequently interconnected or attached to mechanical devices, placed at a upper position in relation to the load. These devices are called load lifting winches that retrieve and store cables or chains when hoisting a load.

The lifting winches, when intended to perform hoisting operations on large amplitude vertical paths, often include cylindrical cable drums that are also able to store the wire cables. They are also typically driven through the main axis of the cylindrical cable drum.

It's also possible to observe the existence of cylindrical drum winches with tangential drive to the drum using a spur gear transmission. Here the sprocket is mounted inside or outside the drum perimeter. The drive speed being constant and cylindrical geometry of the drum being also constant along its major axis, it translates into a constant cable winding speed as well. The load on the cable is subjected results from subdividing the total lifting load by introducing rope reeving sheaves both placed near the drum and hook, respectively sheaves top block and bottom block.

A cylindrical drum is featured by maximizing the cable storage along its perimeter. Given the cylindrical geometry of the drum, the winding length per drum rotation is constant along its length. Therefore, to increase the total winding length, it becomes necessary to increase the diameter of the cylindrical drum or, alternatively, increase the total cylindrical drum length or both. The engine torque at the main axis of the drum, required to lift the load increases proportionally to the diameter, increases proportionally as the drum diameter increase. This also means that the approach distance of the hook to the drum axis will have to proportionally increase as well.

The variable rotational speed in cylindrical drum winches is achieved by adding electromechanical variable drive systems or electronic devices such as adjustable AC or DC drives.

SUMMARY

In accordance with the disclosure, a load lifting winch suspending a load from a hook and a cable which is wound onto a frustoconical drum in order to reduce the winch vertical dimension when the hook is in the fully upright position allowed by available vertical space elevation, and simultaneously decrease the forces applied to the lifting drive motor as the load rises.

Accordingly, it is an advantage of the present disclosure to provide an improved load lifting winch.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

Figure 1:
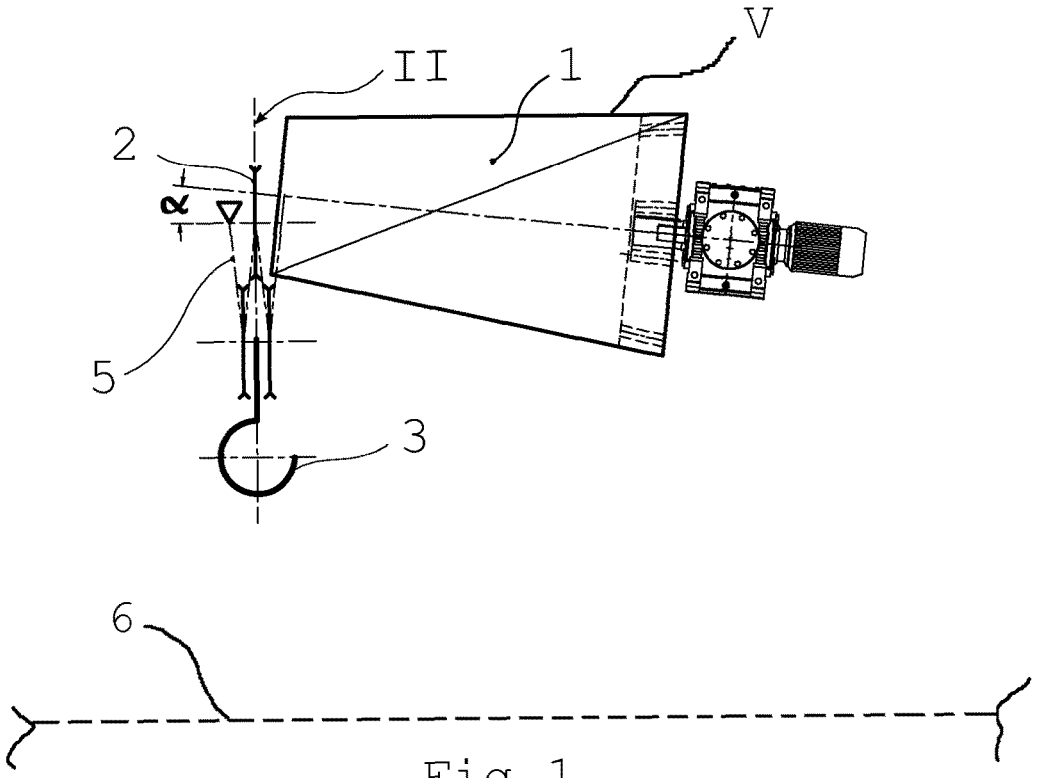
FIG. 1 is a front view of a frustoconical drum winch for lifting loads with hook reduced approximation lifting height.
Figure 2:
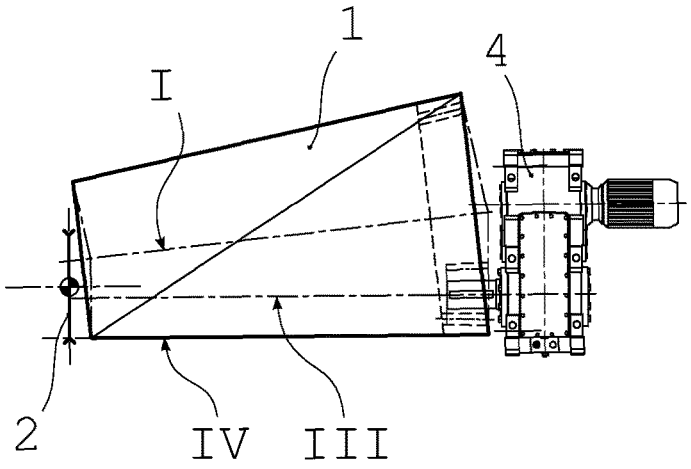
FIG. 2 is a view of a frustoconical drum winch for lifting loads with hook reduced approximation lifting height when the a approach angle value of the main rotation axis (I) is zero.

A frustoconical drum winch for lifting loads above surface (6) with hook reduced approximation lifting height, as shown in FIG. 1, is characterized by the use of a frustoconical drum (1) with a worm groove housing the cable (5) hanging the load by a hook with sheaves (3). The frustoconical drum (1) houses the same cable (5) length as a traditional cylindrical drum with the same length whereas the cylindrical drum diameter is identical to the average of the extreme diameters of the frustoconical drum (1). For a given lifting height above surface (6), both have the same cable length storage capacity. However, the approach minimal height of the hook (3) to the main rotation axis (I) of the frustoconical drum (1) has a comparatively lower value corresponding to the difference between the minimum diameter of the frustoconical drum (1) and the diameter of the equivalent traditional cylindrical drum, by tilting the main rotation axis (I) of the frustoconical drum (1) with an $\alpha$ value, in relation to the reference axis of the upper sheave (2) contained in the plane (II).

The frustoconical drum winch for lifting loads with hook reduced approximation lifting height is also characterized by proportionally reducing the resistant load torque by the ratio between the diameter of the frustoconical drum section (1), orthogonal to the main axis (I), concurrent with the exit point of the cable (5), and the maximum diameter of the frustoconical drum (1) end top, applied to axis (III) of the drive motor (4). The resistant load torque applied to the axis (III) is maximum when the cable (5) is completely unwound, corresponding to the load suspended from the lower lift point. Its value is equal to the force applied by the load to the cable (5) multiplied by the distance between the drive motor (4) axis (III) and the cable (5) contact point with the frustoconical drum (1) coincident with the alignment of the conical generatrix line (IV).

Equivalently, the frustoconical drum winch for lifting loads with hook reduced approximation lifting height, driving a constant rotation speed in the axle (III), also inducing a constant main axis (I) rotation speed, is characterized by a linear variation lifting speed ratio corresponding to the ratio between the diameter of the frustoconical drum section (1), orthogonal to the main axis (I), concurrent with the exit point of the cable (5), and the maximum diameter of the frustoconical drum (1) end top.

Therefore, lifting loads with smaller volume typically occur at higher lifting speeds, thereby making this type of winch more productive than the cylindrical drum. Heavier loads lifting movements occur at slower lifting speeds, thereby decreasing the safety risks of operating heavier loads with larger volume.

The upper sheave (2), aligned by the plane (II), is top view positioned beside the frustoconical drum (1) smaller diameter end top. The rotation axis of the upper sheave (2) forms an $\alpha$ tilt angle value with the plane formed by the drive motor (4) axis (III) and the conical generatrix (IV). From the same top view, the upper sheave (2) is positioned in a way that the distance from the rotation axis of the upper sheave (2) to the conical generatrix (IV) or top frustoconical generatrix (V) corresponds to half the diameter of the upper sheave (2) so that the hook's center of gravity with pulleys (3) is placed in the vertical plane along the rotational axis of the upper sheave (2).

Figure 3:
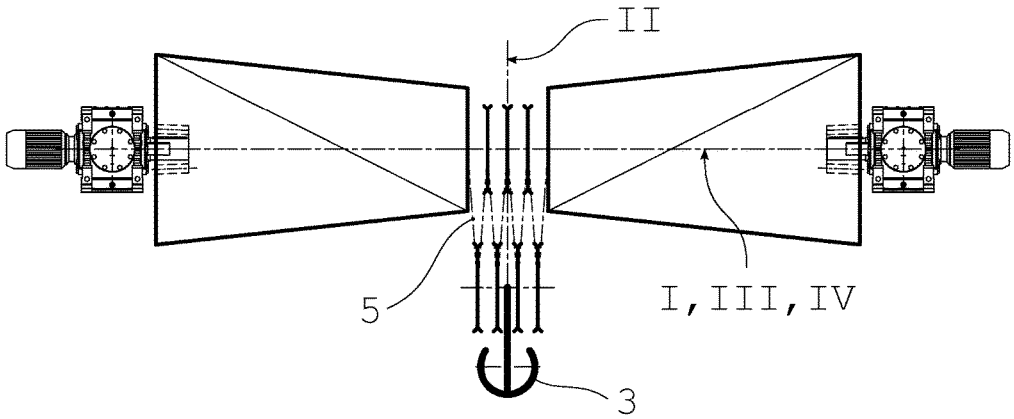
FIG. 3 is a front view of two symmetrical frustoconical drum assembly winch for lifting loads with hook reduced approximation lifting height.
Figure 4:
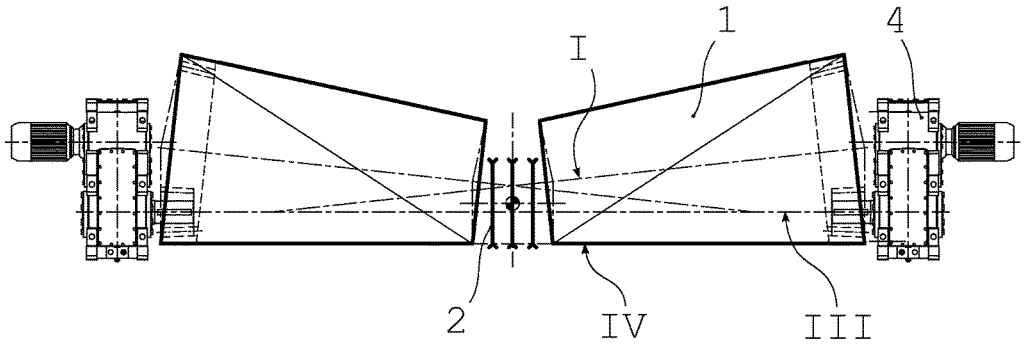
FIG. 4 is a top view of two symmetrical frustoconical drum assembly winch for lifting loads with hook reduced approximation lifting height winch.

As also shown in FIG. 3 front view and FIG. 4 top view, the frustoconical drum winch for lifting loads with hook reduced approximation lifting height presents also a double frustoconical drum (1) configuration, symmetric along axis II, needed when the horizontal displacement of the hook (3) is not desired while lifting the load. In this case, the cable (5) is symmetrically wounded on both frustoconical drums. The upper sheave (2) block is also assembled beside each end top of the frustoconical drum (1) with smaller diameter.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A frustoconical drum winch for an overhead or gantry crane for lifting loads from a surface on which the loads are positioned, to a height elevated above the surface with hook reduced approximation lifting height, characterized by using a hook that lifts by winding a cable on a frustoconical drum up to a height dimension higher than a lower point of a median diameter of the frustoconical drum, wherein a top frustoconical generatrix of the frustoconical drum has a fixed orientation relative to the surface from which lifting is to be performed and an upper sheave with a rotation axis that forms a tilt angle $\alpha$ from a rotation angle of a drive motor for the winch, said tilt angle being greater than zero relative to a rotation axis of the drive motor for the winch.

2. A frustoconical drum winch for an overhead or gantry crane for lifting loads with hook reduced approximation lifting height, according to claim 1, wherein the upper sheave is positioned parallel to a smaller diameter end top of the frustoconical drum.

3. A frustoconical drum winch for an overhead or gantry crane for lifting loads with hook reduced approximation lifting height, according to claim 1, wherein the cable is in contact with a point of largest diameter perpendicular section to a main axis of the frustoconical drum when the cable is completely unwound.

* * * * *